United States Patent [19]

Unland et al.

[11] Patent Number: 4,840,561

[45] Date of Patent: Jun. 20, 1989

[54] APPARATUS FOR THE HEAT TREATMENT OF FINE-GRAINED MATERIAL

[75] Inventors: Georg Unland, Ennigerloh; Günter Driemeier, Lienen, both of Fed. Rep. of Germany

[73] Assignee: Krupp Polysius AG, Fed. Rep. of Germany

[21] Appl. No.: 145,384

[22] Filed: Jan. 19, 1988

[30] Foreign Application Priority Data

Jan. 23, 1987 [DE] Fed. Rep. of Germany ..... 3701964

[51] Int. Cl.[4] ..... F27B 7/02

[52] U.S. Cl. ..... 432/106; 432/58

[58] Field of Search ..... 432/14, 58, 106

[56] References Cited

U.S. PATENT DOCUMENTS

| | | | |
|---|---|---|---|
| 4,201,541 | 5/1980 | Schoppe | 432/106 |
| 4,248,639 | 2/1981 | Quittkat | 432/106 |
| 4,720,262 | 1/1988 | Durr et al. | 432/106 |

*Primary Examiner*—Henry C. Yuen

*Attorney, Agent, or Firm*—Learman & McCulloch

[57] ABSTRACT

The invention relates to apparatus for the heat treatment of fine-grained material with a rotary drum furnace, a preheater and a combustion chamber for precalcination, in which the cover of the combustion chamber has a central recess which serves for spin stabilization and has the fuel supply provided in its base. Such a combustion chamber is distinguished by improved combustion conditions, particularly an improved mode of combustion.

10 Claims, 4 Drawing Sheets

APPARATUS FOR THE HEAT TREATMENT OF FINE-GRAINED MATERIAL

The invention relates to apparatus for the heat treatment of fine-grained material, such as cement raw material.

Apparatus of the general class disclosed herein is known for example from DE-A-24 51 197 and 27 37 992. Such apparatus facilitates precalcination (deacidification) of the preheated material in a combustion chamber supplied with exhaust air from a cooler (tertiary air), and the material which has already been greatly heated in this way and largely deacidified is then introduced into the furnace exhaust gas pipe and here undergoes further deacidification by means of the hot furnace exhaust gases and possibly additional fuel before it passes into the rotary drum furnace after separation in the lowest cyclone of the preheater.

In the known apparatus of this type the cover of the combustion chamber which is of cylindrical construction in the upper region is substantially level and provided in the region of its centre with the fuel supply. Practical experience with such apparatus show it to be desirable to improve the combustion conditions in the combustion chamber and the start of the combustion.

This object is achieved by apparatus constructed according to the invention. Advantageous embodiments of the invention are disclosed in the drawings wherein.

The apparatus illustrated in FIGS. 1 to 4 for the heat treatment of fine-grained material, particularly cement raw material, contains a multi-stage preheater 1 which is only shown quite schematically and serves to preheat the material. This preheater 1 preferably consists of a plurality of cyclones which are connected to one another by their gas and material pipes and in which the material is preheated in stages by the hot exhaust gases from the combustion and precalcination zone which is described below.

Figure 1:
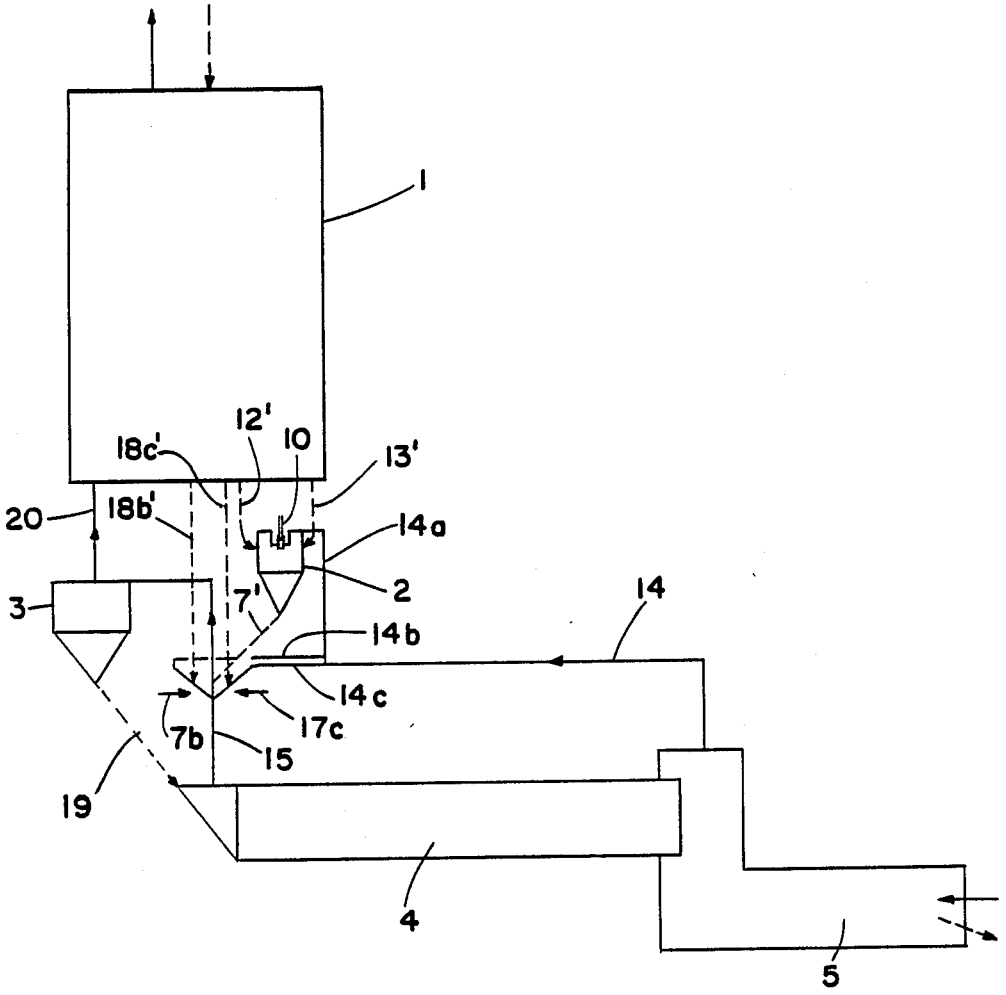
FIG. 1 shows a schematic representation of a first embodiment of the apparatus according to the invention.
Figure 3:
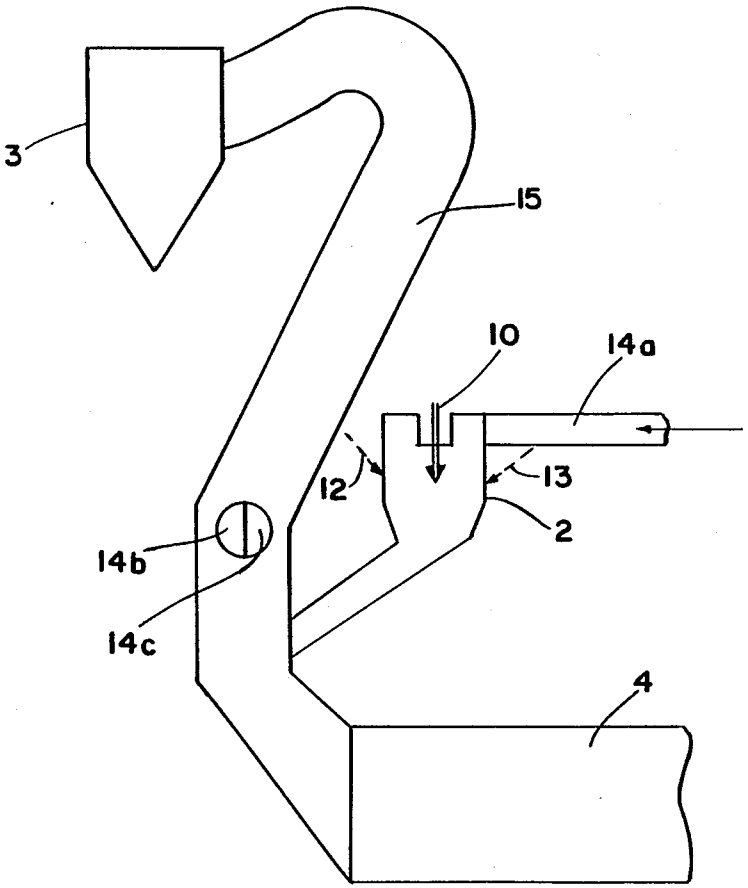
FIGS. 2 and 3 show partial representations of the elements of the apparatus according to FIG. 1 which are essential to the invention.

The apparatus according to FIG. 1 also contains a combustion chamber 2, a cyclone 3, a rotary drum furnace 4 and a cooler 5.

Figure 4:
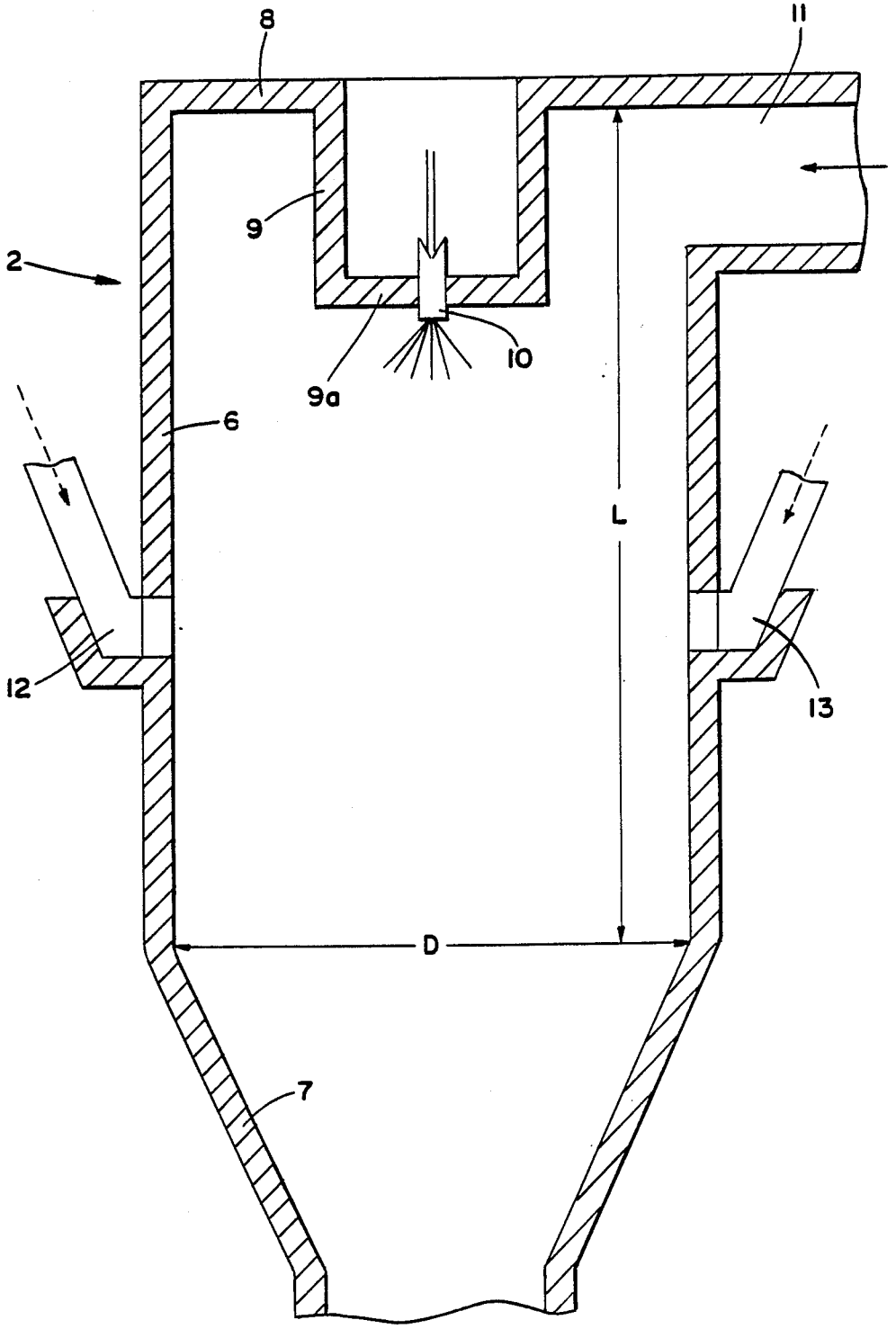
FIG. 4 shows a section through the combustion chamber according to FIGS. 1 to 3.

The combustion chamber 2 which is shown in detail in FIG. 4 contains an upper region 6 of cylindrical construction and a lower region constructed as a hopper 7. The cover 8 of the combustion chamber is provided with a downwardly-directed central recess 9, the base 9*a* of which is provided with a fuel supply 10.

In addition the combustion chamber 2 contains a tangential combustion air supply 11 in the upper region at the level of the central recess 9. The base 9*a* of the central recess 9 is somewhat lower than the the underside of the tangential combustion air supply 11.

In the central part of the level of the upper cylindrical region 6 of the combustion chamber two diametrically opposed material supplies 12, 13 (for example in the form of dispersion boxes) are provided in the peripheral wall of the combustion chamber.

The ratio of the length L to the diameter D of the upper cyclindrical region 6 of the combustion chamber is advantageously between 2 and 2.5.

In the embodiment illustrated in FIGS. 1 to 4 a pipe 14 which is connected to the cooler 5 and conducts exhaust air from the cooler (so-called tertiary air) branches into one pipe 14*a* which is connected to the combustion chamber 2 and two pipes 14*b*, 14*c* which are connected directly to the furnace exhaust gas pipe 15 connecting the rotary drum furnace to the cyclone 3.

Figure 2:
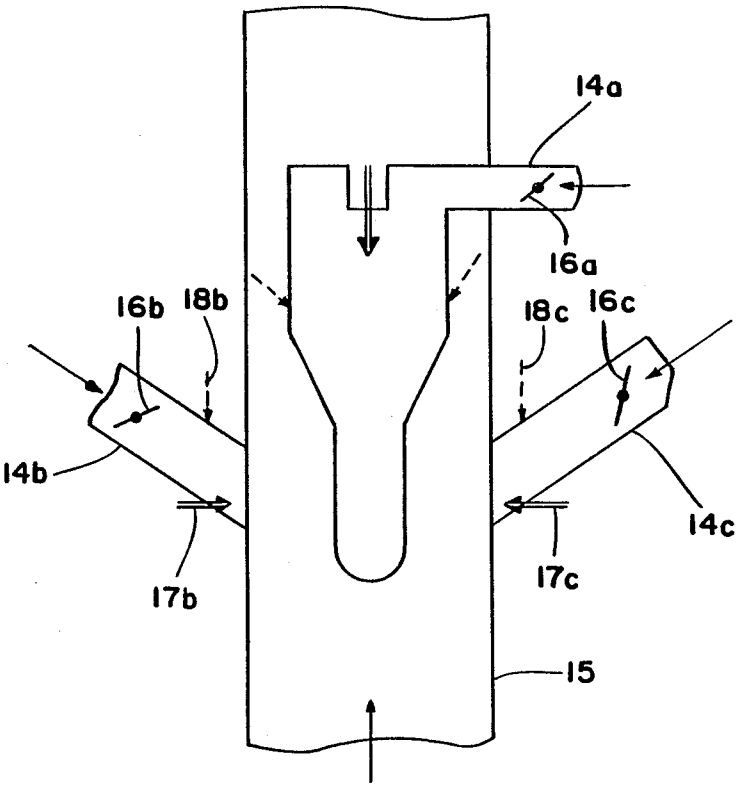

The pipe 14*a* opens via the aforementioned combustion air supply 11 into the combustion chamber 2, whilst the pipes 14*b* and 14*c*—as can be seen from FIG. 2—open with a downwards inclination into the furnace exhaust gas pipe 15. Valves 16*a*, 16*b*, 16*c* are provided in the said three pipes 14*a*, 14*b* and 14*c* to adjust the air streams introduced into the combustion chamber 2 into the furnace exhaust gas pipe 15.

The hopper 7 of the combustion chamber 2 is connected to the furnace exhaust gas pipe 15, and the point at which this hopper 7 opens into the furnace exhaust gas pipe 15 can lie at the same level, above or below the point at which the pipes 14*b* and 14*c* open.

Shortly before the point at which they open into the furnace exhaust gas pipe 15 the pipes 14*b* and 14*c* are provided with connections 17*b*, 17*c* for the supply of fuel and with connections 18*b*, 18*c* for the supply of preheated material (cf FIG. 2). The material pipes leading from the preheater 1 to the connections 18*b*, 18*c* are designated schematically by 18'*b* and 18'*c* respectively in FIG. 1. In a corresponding manner the pipes leading to the material supplies 12, 13 of the combustion chamber 2 are designated by 12' and 13' respectively. The material pipe leading from the hopper 7 to the furnace exhaust gas pipe 15 is designated by 7'.

The apparatus advantageously contains arrangements (not illustrated in the drawings) to enable the material streams introduced into the combustion chamber 2 and directly into the furnace exhaust gas pipe 15 to be adjusted as required.

The illustrated apparatus functions as follows:

The fine-grained material is preheated in the preheater 1 with the hot exhaust gases from the rotary drum furnace 4 and the combustion chamber 2. An adjustable proportion of the preheated material passes from the preheater 1 via the pipes 12', 13' into the combustion chamber 2 where it is further heated and greatly deacidified by the additional fuel supplied at 10. The central recess 9 provided in the cover of the combustion chamber 2 serves for spin stabilisation of the combustion air which is supplied tangentially. The fuel is introduced centrally into the combustion chamber 2 via the supply pipe 10 and ignites in pure air. At approximately half the height of the cylindrical upper region 6 of the combustion chamber 2 the material passes via the supply pipes 12, 13 into the combustion chamber 2. At the same time the temperature in the combustion chamber is controlled.

The material which is greatly deacidified in the combustion chamber 2 then passes via the pipe 7' into the furnace exhaust gas pipe 15 and is there mixed together with the material streams which in the illustrated embodiment are introduced via the pipes 18'*b*, 18'*c* into the tertiary air pipes 14*b*, 14*c* which open directly into the furnace exhaust gas pipe 15. For the deacidification of these material streams further fuel is introduced via the connections 17*b*, 17*c* into the pipes 14*b*, 14*c* (immediately before the points at which they open into the furnace exhaust gas pipe 15).

The material separated off in the cyclone 3 is then delivered via a pipe 19 to the rotary drum furnace 4 where it is burnt to clinker and is then cooled in the cooler 5. The gas stream which is free of material is delivered via a pipe 20 to the further stages of the preheater 1.

Figure 5:
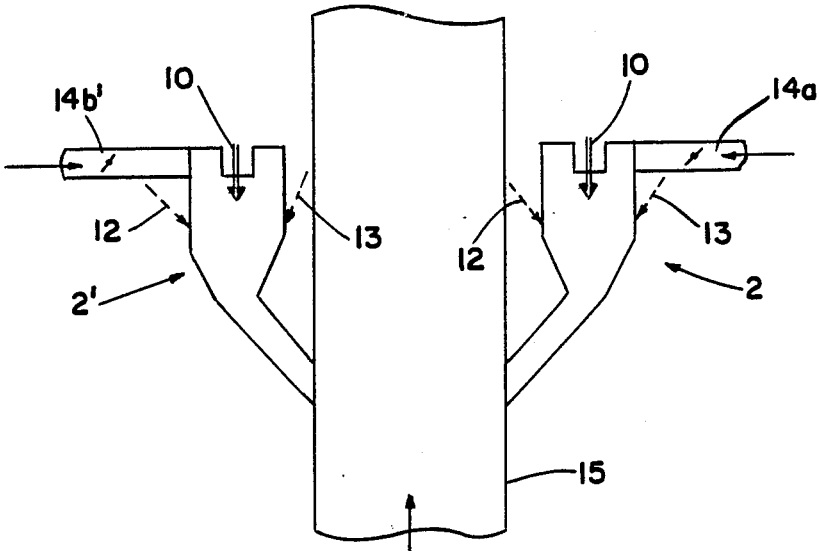
FIGS. 5 to 7 show schematic representations (corresponding to FIG. 2) of three further embodiments of the invention.

FIG. 5 shows in schematic form an embodiment in which the pipe 14 conducting the exhaust air from the cooler only branches into two pipes 14*a*, 14'*a* which are each connected to a combustion chamber 2 or 2' respectively. The hoppers of these combustion chambers 2, 2' are connected at different points to the furnace exhaust gas pipe 15 (the points at which they open do not have to be at the same level but can be offset in terms of height). The combustion chambers 2, 2' are constructed in the same manner as has already been described with the aid of FIG. 4.

Figure 6:
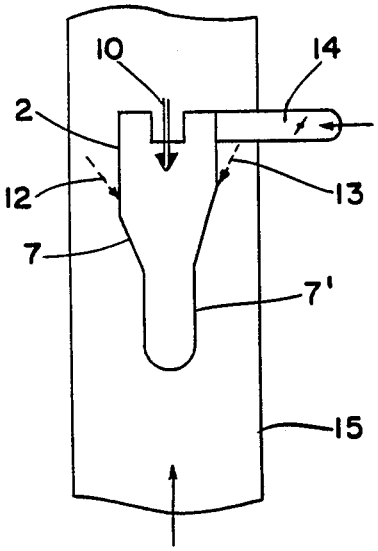

FIG. 6 shows a variant in which the pipe 14 conducting the tertiary air is not branched, but is connected to one single combustion chamber 2, the hopper 7 of which is connected to the furnace exhaust gas pipe 15. In this embodiment the total quantity of material coming from the preheater 1 is generally introduced into the combustion chamber 2.

Figure 7:
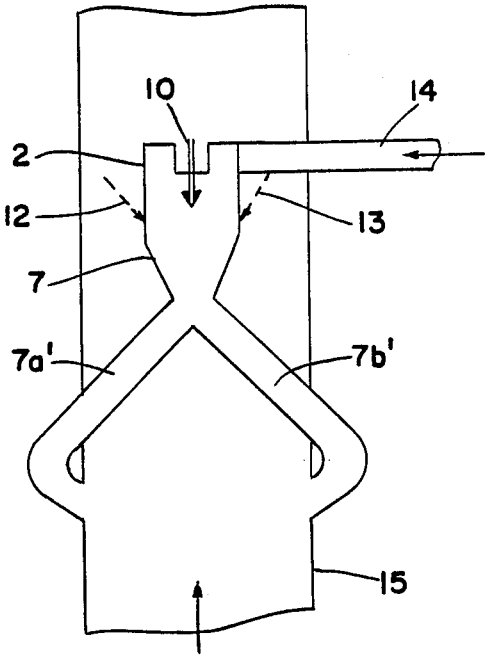

Finally, a variant of the construction according to FIG. 6 is shown in FIG. 7, in which the hopper 7 of the single combustion chamber 2 branches into two pipes 7'*a*, 7'*b* which open into the furnace exhaust gas pipe 15 at different points.

Otherwise the construction of the combustion chamber 2 corresponds to that of the embodiment according to FIG. 4.

We claim:

1. In apparatus for heat treating fine-grained material, such as cement raw material, including (a) a multi-stage preheater for preheating the material, (b) an upright combustion chamber in communication with said preheater for precalcining the preheated material, (c) a rotary drum furnace for receiving and burning the precalcined material and having an exhaust pipe in communication with the preheater, and (d) a cooler in communication with said furnace for receiving and cooling the burnt material, (e) said combustion chamber being cylindrical at its upper region and forming a hopper at its lower region; said combustion chamber having at its upper region a cover, a fuel supply, and a tangential inlet communicating with a conduit for receiving combustion air from said cooler; said combustion chamber having at least one material supply for receiving preheated material from said preheater; said lower region of said combustion chamber having an opening therein for the delivery of precalcined material and gases of combustion to said exhaust pipe, the improvement wherein:

(f) said cover has a downwardly extending recess therein at the level of the combustion air inlet, said recess having a base on which said fuel supply is mounted.

2. Apparatus as claimed in claim 1 wherein said inlet has an underside at a level above that of said base.

3. Apparatus as claimed in claim 1 where said material supply is positioned at a level substantially central of the cylindrical region of the combustion chamber.

4. Apparatus as claimed in claim 1 including an additional material supply for said cumbustion chamber diametrically opposite said one material supply.

5. Apparatus as claimed in claim 1 wherein said cylindrical region of the combustion chamber has a length to diameter rotation of between 2 and 2.5.

6. Apparatus as claimed in claim 1 wherein said conduit branches into a pipe in communication with the combustion chamber and at least one other pipe connected directly to the furnace exhaust pipe, said other pipe being provided shortly upstream from its connection to the furnace exhaust pipe with connections for the delivery of fuel and preheated material from said preheater.

7. Apparatus as claimed in claim 6 including means for adjusting the air delivered to the combustion chamber and to the furnace exhaust pipe, and additional means for adjusting the material introduced into the combustion chamber and into the air pipe.

8. Apparatus as claimed in claim 6 wherein said other pipe branches with a third pipe connected directly to the furnace exhaust pipe at a point different from that at which said other pipe is connected to the furnace exhaust pipe.

9. Apparatus as claimed in claim 1 wherein said conduit branches into a second conduit which is connected in a similar manner to a similar, second combustion chamber, the hopper of the second combustion chamber being connected to the furnace exhaust pipe.

10. Apparatus as claimed in claim 1 wherein the hopper of the combustion chamber has two pipes which open into the furnace exhaust pipe at different points.

* * * * *